US006695027B2

(12) United States Patent
Hashimoto

(10) Patent No.: US 6,695,027 B2
(45) Date of Patent: Feb. 24, 2004

(54) SPEED MATCHING SYSTEM FOR A WEB SPLICER MECHANISM IN A WEB-FED PRINTING PRESS OR THE LIKE

(75) Inventor: Nobuaki Hashimoto, Tokyo (JP)

(73) Assignee: Kabushiki Kaisha Tokyo Kikai Seisakusho, Tokyo (JP)

( * ) Notice: Subject to any disclaimer, the term of this patent is extended or adjusted under 35 U.S.C. 154(b) by 164 days.

(21) Appl. No.: 09/994,655

(22) Filed: Nov. 28, 2001

(65) Prior Publication Data

US 2002/0074087 A1 Jun. 20, 2002

(30) Foreign Application Priority Data

Dec. 14, 2000 (JP) ..... P2000-380119

(51) Int. Cl.[7] ..... B32B 31/08; B65H 19/00

(52) U.S. Cl. ..... 156/351; 156/361; 156/366; 156/367; 156/378; 156/502; 156/504

(58) Field of Search ..... 156/351, 361, 156/366, 367, 502, 504, 358, 505, 506, 378, 379, 360; 242/554.3, 554.5, 554.6, 555, 555.3, 555.5, 555.6, 555.7, 563.2

(56) References Cited

U.S. PATENT DOCUMENTS 3,298,623 A 1/1967 Lighton et al.
5,253,819 A 10/1993 Butler, Jr.
6,096,150 A * 8/2000 Ohno ..... 156/157

FOREIGN PATENT DOCUMENTS

GB 2015740 A 9/1979
JP 01150661 A 6/1989
JP 2000-143046 5/2000

* cited by examiner

*Primary Examiner*—Richard Crispino
*Assistant Examiner*—George R. Koch, III
(74) *Attorney, Agent, or Firm*—Rader Fishman & Grauer

(57) ABSTRACT

An apparatus splices a web of paper being paid out from a one web roll and fed into a printing press to another web roll being rotated in a splicing position. The new web roll of any diameter is spaced a prescribed distance from the old web traveling along a predefined path into the press. A sensor positioning mechanism adjustably moves a photoelectric web roll speed sensor along two orthogonal axes to an optimum sensing position with respect to the new web roll regardless of its diameter. An electronic control circuit has an input connected to a speed sensor for the old web traveling along the predefined path, and another to the photoelectric speed sensor for the new web roll, for energizing a new web roll drive motor according to a departure of the peripheral speed of the new web roll from the running speed of the old web.

11 Claims, 4 Drawing Sheets

SPEED MATCHING SYSTEM FOR A WEB SPLICER MECHANISM IN A WEB-FED PRINTING PRESS OR THE LIKE

BACKGROUND OF THE INVENTION

1. Field of the Invention

This invention relates generally to a mechanism for splicing one continuous web of paper or like material, which is being fed into a printing press or like machine by being paid out from its roll, to a new roll of such web as the old roll is nearly used up. More specifically, the invention deals with a system to be incorporated with such web splicer mechanism for automatically driving the new web roll at a peripheral speed matching the running speed of the old web, preparatory to the splicing of the old web to the new roll.

2. Description of the Prior Art

In a web-fed printing press for newspaper production, for instance, the web of paper being printed upon by being unwound from its roll is automatically spliced to a new web roll, which is in rotation with a peripheral speed matching the running speed of the old web, as the old web roll is consumed to a predefined diameter, in a manner causing no interruption in printing. A successful splicing of the webs depends to a large measure upon the matching of the peripheral speed of the new web roll to the running speed of the old web. A variety of suggestions have indeed been made toward this end.

Typical of such known suggestions, and perhaps bearing the closest resemblance to the instant invention, is Japanese Unexamined Patent Publication No. 1-150661. It teaches to sense the peripheral speed of the new web roll photoelectrically, by means comprising a laser and an associated photoreceptor, as the roll is set into rotation in a predetermined splicing position immediately downstream of the old web roll being consumed. The photoelectrically detected peripheral speed of the new web roll is compared, by associated control electronics, with the running speed of the old web. The drive motor of the new web roll has its speed controlled according to the departure of the peripheral speed of the new web roll from the traveling speed of the old web, in order to match the two speeds and hence to splice the old web to the new web roll without a break in printing.

This prior art system has some ambiguities and obvious shortcomings. The two web rolls to be spliced together are both mounted to a rotary roll stand comprising one pair of carrier arms rotatably carrying one web roll, and another such pair rotatably carrying the other web roll. The two pairs of carrier arms are both mounted to a rotary shaft and extend in diametrically opposite directions therefrom. As the old web roll is consumed to a predetermined diameter, the two carrier arm pairs are jointly turned through an angle required to bring the new web roll to a splicing position spaced a preassigned distance from the old web being fed into the press by being paid out from the old web roll.

The trouble is that new web rolls come in several different diameters, not in one. According to the current standards the minimum diameter of unused web rolls is only six tenths of the maximum. When the roll stand is turned through a required angle as above, the new web roll of any given diameter can be positioned at the prescribed spacing from the old web traveling along its predefined path. This, however, does not mean that new web rolls of varying diameters occupy the same position with respect to the old web. Their axes will be in different positions depending upon their diameters.

In photoelectrically sensing the rotational speed of the new web roll, as suggested by the prior art, it is essential that both light source and photoreceptor be positioned at prescribed spacings from, and at prescribed angles to, the new web roll; otherwise, the peripheral speed of the roll would be either undetectable or not accurately detectable. The Japanese patent application cited above discloses no means whatsoever for correctly positioning the photoelectric sensor means with respect to the new web rolls of varying diameters. This prior art apparatus can detect the peripheral speed of the new web roll having a prescribed diameter only, or a diameter in a narrowly limited range of diameters only.

The cited Japanese patent application teaches to compare the peripheral speeds of the old and the new web roll for matching them, suggesting use of a pulse generator for detecting the peripheral speed of the old web roll. The peripheral speed of the old web roll is said to be detectable by multiplying the angular velocity of the old web roll by its diameter. The application is, however, silent on where the pulse generator is positioned, how the angular velocity of the old web roll is ascertained by the pulse generator, and how the roll diameter, which is incessantly diminishing, is determined.

SUMMARY OF THE INVENTION

The present invention has it as a general object to splice successive rolls of paper web or the like without any such trouble as web breakage or misprinting and hence to drastically improve the efficiency of printing through reduction of downtime due to such causes.

A more specific object of the invention is to make it possible to position the photoelectric speed sensor in the correct sensing position relative to the new web roll being held in the splicing position, regardless of its diameter or, to be more exact, no matter which of the standardized diameters it may have.

Briefly, the present invention concerns, in an apparatus for splicing a web of paper or like material, which is traveling at any given speed along a predefined path by being unwound from an old web roll, to a new web roll of a variable diameter being rotated in a splicing position in which the new web roll of any diameter is spaced a prescribed constant distance from the web traveling along the predefined path, a speed matching system for matching the peripheral speed of the new web roll to the running speed of the old web traveling along the predefined path preparatory to the splicing of the webs.

More specifically, the web speed matching system according to the invention comprises a first speed sensor for sensing the running speed of the web traveling along the predefined path by being unwound from the old web roll, and a second speed sensor for photoelectrically sensing the peripheral speed of the new web roll being driven in the splicing position. For optimally positioning the second speed sensor relative to the new web roll of a variable diameter being held in the splicing position, there is provided a sensor positioning mechanism capable of moving the second speed sensor along two orthogonal axes which are determined in relation to the axis of rotation of the new web roll. An electric control circuit is provided which has inputs connected respectively to the first and the second speed sensor, and an output connected to the drive means for the new web roll, in order to cause the latter to be controllably energized according to the possible departure of the peripheral speed of the new web roll, in rotation in the splicing position, from the running speed of the old web traveling along the predefined path.

Thus, whatever the diameter of the new web roll may be, within, of course, reasonable limits, the second speed sensor can be optimally positioned for correct measurement of its peripheral speed. A correct measurement of the peripheral speed of the new web roll leads to correct determination of its departure from the running speed of the old web, and hence to correct energization of the new web roll drive motor for matching the new web roll peripheral speed to the traveling speed of the old web.

In the preferred embodiment to be disclosed subsequently, the sensor positioning mechanism comprises first drive means for reciprocably moving the second speed sensor in a first direction at right angles with the axis of the new web roll, second drive means for reciprocably moving the second speed sensor in a second direction at right angles with the first direction and with the axis of the new web roll, and a sensor positioning control circuit electrically connected to the first and the second drive means for controlling the same.

The new web roll is rotatably mounted to a rotary web roll stand which is angularly displaceable to carry the new web roll from a standby position to the splicing position. Therefore, in the preferred embodiment, a displacement sensor is provided for sensing the angle of displacement of the web roll stand in moving the new web roll from the standby position to the splicing position. The sensor positioning control circuit is electrically connected to the displacement sensor for ascertaining the position of the axis of the new web roll in the first direction on the basis of the angle of displacement of the web roll stand and for causing the first drive means to bring the second speed sensor to a preselected position in the first direction.

The preferred embodiment also includes a web roll distance sensor for sensing its own distance from the surface of the new web roll, the distance sensor being supported in fixed positional relationship to the second speed sensor for joint movement therewith. The sensor positioning control circuit is electrically connected not only to the web roll stand displacement sensor but to the web roll distance sensor as well. Receiving outputs from these sensors, the sensor positioning control circuit is enabled to automatically readjust the position of the second speed sensor for most accurate determination of the peripheral speed of each new web roll as the latter is carried to the splicing position and set into rotation for splicing.

The above and other objects, features and advantages of this invention will become more apparent, and the invention itself will best be understood, from a study of the following description and appended claims, with reference had to the attached drawings showing the preferred embodiment of the invention.

DESCRIPTION OF THE PREFERRED EMBODIMENT

General

Figure 1:
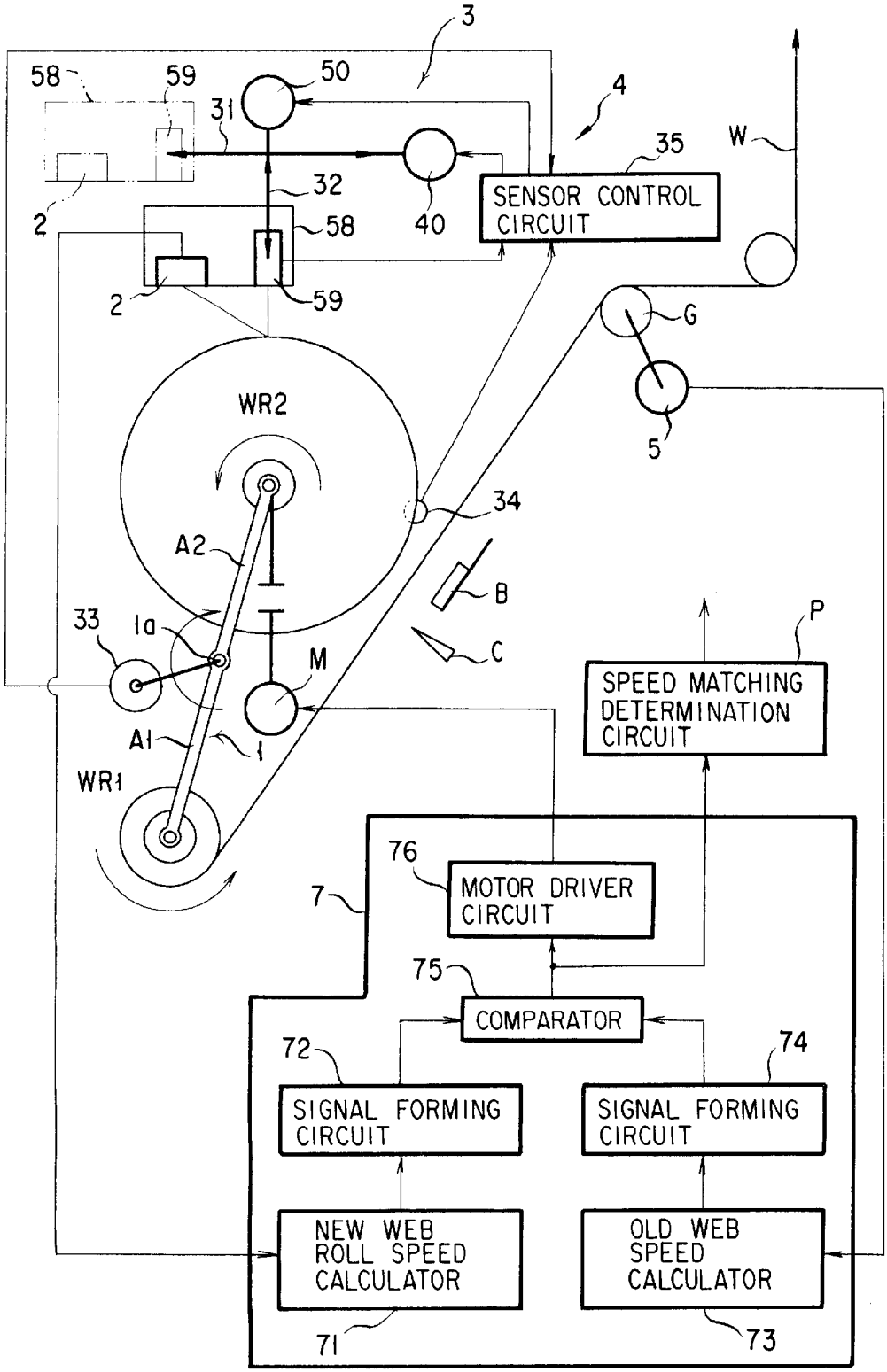
FIG. 1 is a combined pictorial and block-diagrammatic illustration of the web splicer mechanism for a web-fed printing press incorporating the photoelectric speed sensing and matching system according to the present invention.

The present invention is believed to be best applicable to the splicing of the old and new webs at the infeed station of a web-fed printing press. In FIG. 1 is therefore shown the speed matching system of this invention together with an old web roll $WR_1$, from which the web of paper W is now being paid out and fed into the press, and a new web roll $WR_2$ to which the old web W is to be spliced. Both old and new web rolls $WR_1$ and $WR_2$ are rotatably mounted to a rotary web roll stand 1 which in turn is rotatably mounted to a shaft 1*a*. The web rolls $WR_1$ and $WR_2$ are therefore rotatable not only about there own axes but about the axis of the shaft 1*a*.

As seen in FIG. 1, the old web roll $WR_1$ rotates counterclockwise at approximately constant angular speed as the old web W is pulled into the machine. A drive motor M is for driving the new web roll $WR_2$ in the same direction as the old web roll $WR_1$ and at the same peripheral speed as the traveling speed of the web W being fed into the press from the old web roll. This drive motor M can be drivingly coupled to, and uncoupled from, the new web roll $WR_2$.

For matching the peripheral speed of the new web roll $WR_2$ to the running speed of the web W being unwound from the old web roll $WR_1$, the speed matching system according to the invention comprises: (a) an photoelectric new web roll speed sensor 2 for sensing the peripheral speed of the new web roll $WR_1$; (b) a sensor positioning mechanism 3 for moving the speed sensor 2 along two orthogonal axes to an optimum sensing position with respect to the new web roll $WR_2$ no matter how large it may be in diameter; (c) a sensor positioning control system 4 for electrically controlling the sensor positioning mechanism 3; and (d) an electronic control circuit 7 for controlling the rotational speed of the new web roll drive motor M in response to outputs from the new web roll speed sensor 2 and an old web speed sensor 5 so as to match the peripheral speed of the new web roll $WR_2$ to the traveling speed of the old web W.

At B in FIG. 1 is shown a web splicer for pushing the old web W against the new web roll $WR_2$ for splicing them together after synchronism has been achieved between them. A cutter C is then to cut the old web W in a position immediately upstream of its point of splicing to the new web roll $WR_2$.

Hereinafter in this specification the above noted rotary web roll stand 1, photoelectric web speed sensor 2, sensor positioning mechanism 3, sensor positioning control system 4, and new web roll drive motor control circuit 7 will be discussed in detail in that order and under separate headings. Operational description will follow the discussion of the listed components.

Rotary Web Roll Stand

Itself of conventional make, the rotary web roll stand 1 has a first pair of carrier arms $A_1$ proximally coupled to the rotary shaft 1*a* for joint rotation therewith. Extending from the rotary shaft 1*a* in parallel spaced relationship to each other, the first pair of carrier arms $A_1$ rotatably support the old web roll $WR_1$ between their distal ends. Another similar pair of carrier arms $A_2$ extend in diametrically opposite directions from the rotary shaft 1*a* for rotatably carrying the new web roll $WR_2$. The showing of the two pairs of carrier arms $A_1$ and $A_2$ carrying as many web rolls $WR_1$ and $WR_2$, is by way of example only; in practice, three or more pairs of carrier arms may be mounted to one and the same rotary shaft for carrying as many web rolls.

In the case where two pairs of carrier arms $A_1$ and $A_2$ are provided, as in the illustrated embodiment, while the web W is being paid out from one web roll $WR_1$ on one carrier arm pair $A_1$, the other web roll $WR_2$ is to be held standing by on the other carrier arm pair $A_2$. When the old web roll $WR_1$ is consumed to a predetermined diameter, the rotary shaft 1*a* is to be turned clockwise, as indicated by the arrow in FIG. 1, to bring the new web roll $WR_2$ to the splicing position close to the web W traveling along the predefined path from the old web roll $WR_1$, as depicted also in FIG. 1. Then the new web roll $WR_2$ is to be set into rotation and to have its peripheral speed matched to the running speed of the web W, preparatory to splicing.

Photoelectric Web Speed Sensor

Figure 2:
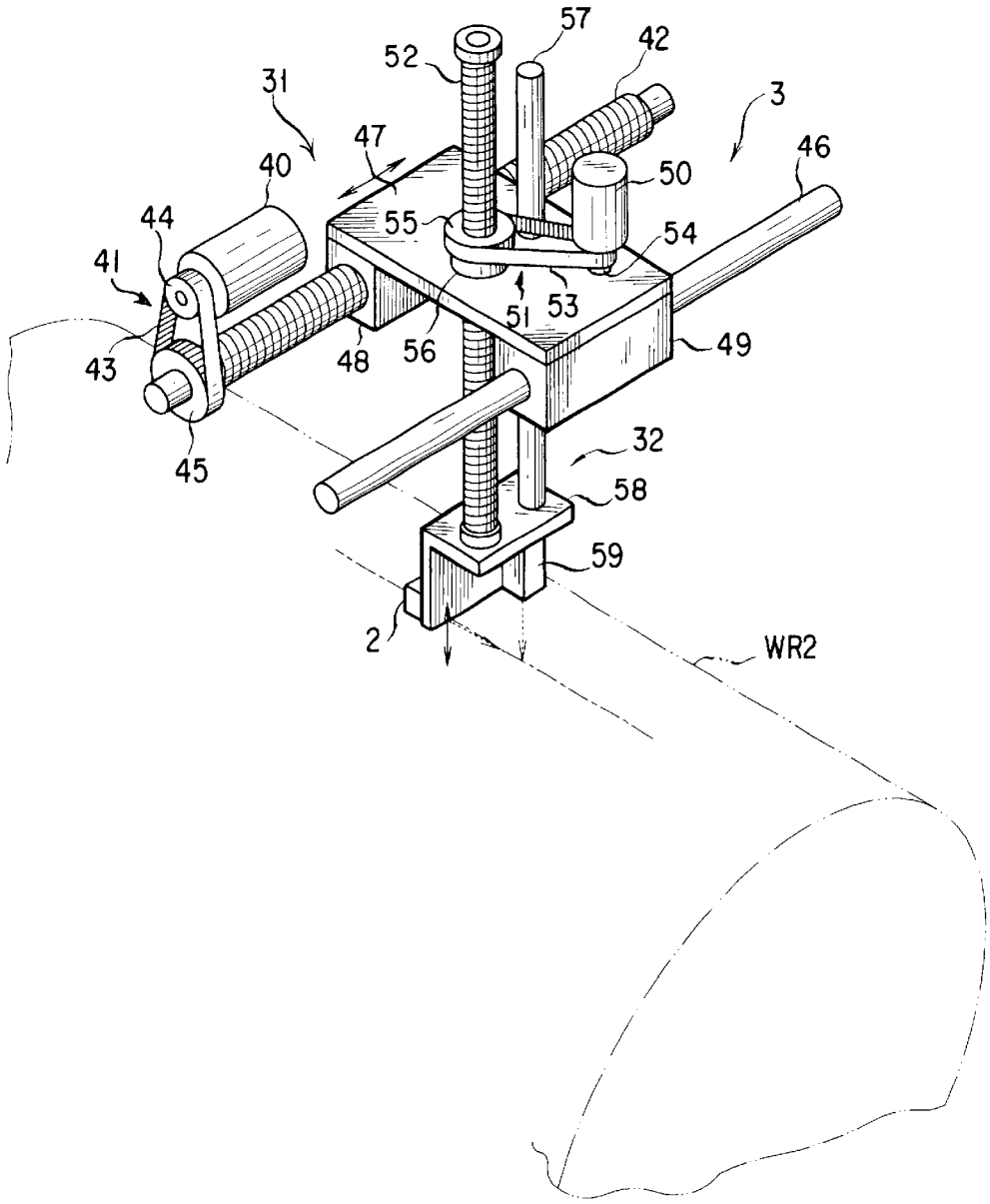
FIG. 2 is an enlarged perspective view of means included in the speed sensing and matching system of FIG. 1 for adjustably moving the photoelectric speed sensor along two orthogonal axes in order to position the same with respect to the new web roll for sensing its peripheral speed.

With reference to both FIGS. 1 and 2 the new web roll speed sensor 2 is mounted to a sensor carrier 58 which forms a part of the sensor positioning mechanism 3 yet to be detailed. When positioned by the sensor positioning mechanism 3, the web speed sensor 2 lies at a preselected angle to, and at a preselected distance from, the line of intersection of a vertical plane containing the axis of rotation of the new web roll $WR_2$, which is being held in the splicing position as in FIG. 1, with the surface of the new web roll. The web speed sensor 2 conventionally comprises a laser for irradiating the required part of the new web roll surface with a laser beam, and a photoreceptor for generating an electric signal representative of the reflection of the laser beam from the roll surface.

The web speed sensor 2 may be of either of the following two operating principles. One is what is referred to as crossbeam sensing, such that the laser beam is emitted in two split parts, which are made to cross each other at the intersection of the vertical plane containing the axis of rotation of the new web roll $WR_2$ with its surface. The peripheral speed of the new web roll $WR_2$ is detected in terms of the interference fringes of the crossing beam parts. The series of dark and light bands produced by the passage of the web roll surface through the intersection of the beam parts is detected by the photoreceptor and translated into an electric signal. The peripheral speed of the new web roll $WR_2$ is ascertained by the control electronics from the cycle of the interference fringes and the angle of intersection of the split beam parts.

The other operating principle is such that the laser beam is made to irradiate the surface of the new web roll $WR_2$ at not more than a prescribed angle (e.g. 30 degrees). The reflection of the laser beam from the roll surface has a frequency deviation in proportion to its speed. The peripheral speed of the new web roll $WR_2$ is therefore detectable on the bases of the angle of beam incidence on the roll surface, the wavelength of the beam, and the magnitude of the frequency deviation.

Sensor Positioning Mechanism

Drawn highly schematically in FIG. 1, the sensor positioning mechanism 3 is better illustrated in perspective in FIG. 2. Mechanically, the sensor positioning mechanism 3 broadly comprises horizontal drive means 31 and vertical drive means 32 for moving the web speed sensor 2 in horizontal and vertical directions, respectively. By being so displaced in the two orthogonal directions, the web speed sensor 2 can be placed in the correct speed sensing position with respect to the underlying new web roll $WR_2$ held in its splicing position, whatever its diameter may be.

The horizontal drive means 31 comprises a bidirectional electric horizontal drive motor 40 mounted to frame means, not shown, of the printing press. The horizontal drive motor 40 is coupled via a drive linkage 41 to a screw-threaded rod 42 which is rotatably supported by the unshown frame means and which extends horizontally and at right angles with the axis of the new web roll $WR_2$. A timing belt 43 is preferred for use as the drive linkage 41 by virtue of its slipless power transfer and accurate timing capability. Having axial cogs molded on its underside, the timing belt 43 positively engages a grooved pulley 44 on the drive shaft of the horizontal drive motor 40 and another such pulley 45 on the threaded rod 42.

Movable along the threaded rod 42 and a guide rod 46 extending in parallel spaced relationship thereto, is a carriage 47 in the form of a flat plate laid horizontally for carrying some parts of the vertical drive means 32 to be set forth subsequently. The carriage 47 has a first shoe 48 which is internally screw-threaded for positive engagement with the threaded rod 42, and another shoe 49 slidably fitted over the guide rod 46. Thus, with the bidirectional rotation of the horizontal drive motor 40, the carriage 47 horizontally travels back and forth together with the parts mounted thereto.

The vertical drive means 32 comprises a bidirectional electric vertical drive motor 50 mounted upstandingly on the carriage 47. The vertical drive motor 50 is coupled via a drive linkage 51 to a screw-threaded rod 52 extending through a hole, not shown, in the carriage 47 in a direction at right angles with the axis of the new web roll $WR_1$ and with the horizontal threaded rod 42. The drive linkage 51 of the vertical drive means 32 is also shown as comprising a timing belt 53 extending over, and positively engaged with, a grooved pulley 54 on the output shaft of the vertical drive motor 50 and another such pulley 55 formed in one piece with a nut or internally screw-threaded member 56. Fitted over the threaded rod 52 in threaded engagement therewith, the nut 56 is rotatably mounted to the carriage 47 while being restrained from axial displacement relative to the same. Thus the threaded rod 52 will longitudinally or vertically travel up and down relative to the carriage 47 with the bidirectional rotation of the vertical drive motor 50. A guide rod 57 vertically and slidably extends through a guide hole cut in the carriage 47.

The threaded rod 52 of the vertical drive means 32 has its bottom end affixed to a sensor carrier 58, as does the vertical guide rod 57. The new web roll speed sensor 2 is mounted to this sensor carrier 58, to which there is also mounted a new web roll distance sensor 59 forming a part of the sensor positioning control system 4.

Sensor Positioning Control System

With reference back to FIG. 1 the sensor positioning control system 4 comprises a sensor positioning control circuit 35 having an output connected to the horizontal drive motor 40, and another output to the vertical drive motor 50, for controlling their angles and directions of rotation. The sensor positioning control circuit 35 has three inputs: one connected to an arm displacement sensor 33, another to a new web roll positioning sensor 34, and still another to the noted new web roll distance sensor 59.

The arm displacement sensor 33 is connected to the rotary shaft 1*a* for sensing the angle of rotation of this shaft, and hence of, in particular, the pair of arms $A_2$ carrying the new web roll $WR_2$. The new web roll positioning sensor 34 senses the arrival of the new web roll $WR_2$ at the splicing position opposite the old web W traveling the predefined path from the old web roll $WR_1$. The new web roll distance sensor 59 determines the distance from the surface of the new web roll $WR_2$ at its intersection with the vertical plane containing the axis of the new web roll.

Upon detection of the new web roll $WR_2$ in the splicing position by the new web roll positioning sensor 34, the sensor positioning control circuit 35 computes the horizontal position, with respect to the axis of the rotary shaft 1*a*, of the intersection of the surface of the new web roll $WR_2$ with the vertical plane containing the axis of the new web roll. In so computing the horizontal position of the new web roll $WR_2$ the sensor positioning control circuit 35 relies on the output from the arm displacement sensor 33 as well as on the length, which is constant, of the carrier arm pair $A_1$ or $A_2$. The horizontal drive motor 40 and vertical drive motor 50 are subsequently controlled according to the thus-computed horizontal position of the new web roll $WR_2$, in order to bring the new web roll speed sensor 2 to the optimal position for sensing its peripheral speed.

New Web Roll Drive Motor Control Circuit

As depicted also in FIG. 1, the new web roll drive motor control circuit 7 comprises a new web roll speed calculator circuit 71 for calculating the peripheral speed of the new web roll $WR_2$, and an old web speed calculator circuit 73 for calculating the traveling speed of the old web W. Having an input connected to the new web roll speed sensor 2, the new web roll speed calculator circuit 71 inputs the output signal therefrom at prescribed time intervals and computes the peripheral speed of the new web roll $WR_2$ in a manner depending upon either of the two operating principles of the photoelectric speed sensor set forth previously. The resulting output from the new web roll speed calculator circuit 71 is input to a new web roll speed signal forming circuit 72, which then responds by putting out a new web roll speed signal representative of the peripheral speed of the new web roll in analog format.

The old web speed calculator circuit 73 has an input connected to the old web speed sensor 5. Typically, the old web speed sensor 5 may take the form of a rotary encoder coupled to a guide roller G which takes part in predefining the path of the web W and which frictionally rotates with the travel of the web. The rotary encoder will produce pulses at a repetition rate proportional to the traveling speed of the web W.

Counting such output pulses of the old web speed sensor 5, the old web speed calculator circuit 73 will compute the traveling speed of the web Won the basis of the number of pulses received during each prescribed time interval at which the new web roll speed calculator circuit 71 takes in the output from the new web roll speed sensor 2. The resulting output from the old web speed calculator circuit is directed into an old web speed signal forming circuit 74, which will then respond by putting out an old web speed signal indicative of the running speed of the old web W in analog format.

The new web roll speed signal forming circuit 72 and the old web speed signal forming circuit 74 are both connected to a comparator circuit 75. Comparing the incoming new and the old web speed signals, the comparator circuit 75 will put out a signal indicative of the departure of the peripheral speed of the new web roll $WR_2$ from the running speed of the old web W. The departure signal is input to a motor driver circuit 76, which is connected to the drive motor M of the new web roll $WR_2$. The motor driver circuit 76 will cause the motor M to be energized so that the peripheral speed of the new web roll $WR_2$ may match the running speed of the old web W.

The departure signal from the new web roll drive motor control circuit 7 will be also applied to a speed matching determination circuit P forming a part of the web splicer mechanism. The departure signal will be utilized by this circuit P for determination of the agreement of the running speed of the old web W with the peripheral speed of the new web roll $WR_2$, which is a prerequisite for successful operation of the splicer mechanism.

Operation

Figure 3:
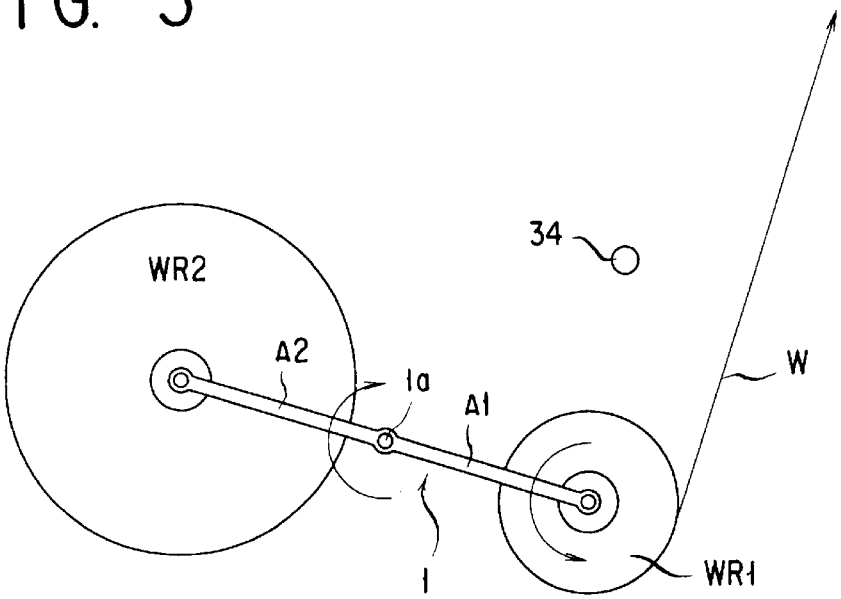
FIGS. 3–6 are a series of end elevational views of the old and the new web roll being spliced by the FIG. 1 web splicer mechanism, the views showing the sequential steps of web splicing.

The rotary shaft 1*a* with the two pairs of carrier arms $A_1$ and $A_2$will be turned clockwise, as in FIG. 3, upon consumption of the old web roll $WR_1$ to a prescribed diameter. The new, unused web roll $WR_2$ will be brought from its FIG. 3 standby position to the splicing position of FIG. 4 opposite the web W being unwound from the old roll $WR_1$. The shaft 1*a* will be automatically set out of rotation when the new web roll $WR_2$ comes to the splicing position, as then the new web roll positioning sensor 34 conventionally senses, perhaps photoelectrically, the coming of the new web roll to the splicing position.

Upon travel of the new web roll $WR_2$ to the splicing position as above, the sensor positioning control circuit 35 will determine the angle of rotation of the shaft 1*a* on the basis of the output from the arm displacement sensor 33. In practice this arm displacement sensor may take the form of an absolute rotary encoder coupled to the shaft 1*a*. The carrier arm pairs $A_1$ and $A_2$ are each constant in length regardless of potentially different diameters of new web rolls to be handled. Furthermore, now that the sensor positioning control circuit 35 knows the angle through which the carrier arm pair $A_2$ has turned to bring the new web roll $WR_2$ to the splicing position, this circuit 35 can compute the horizontal position of the axis of rotation of the new web roll $WR_2$ with respect to the axis of rotation of the carrier arm pair $A_2$ or of the rotary shaft 1*a*.

Next comes the step of positioning the new web roll distance sensor 59, which is mounted to the sensor carrier 58 along with the new web roll speed sensor 2, right above the axis of rotation of the new web roll $WR_2$ which has been carried over to the splicing position as above. To this end the sensor positioning control circuit 35 will set the horizontal drive motor 40 into rotation. The rotation of the horizontal drive motor 40 will be transmitted via the timing belt 43 to the threaded rod 42 thereby causing linear displacement of the carriage 47 which is in threaded engagement with the rod 42 via the shoe 48.

FIG. 1 is drawn on the assumption that the carriage 47, and therefore the sensor carrier 58, have been held standing by in the leftmost position, as viewed in this figure, of the horizontal drive means 31. From this standby position the carriage 47 will travel to the right until the new web roll distance sensor 59 is located vertically above the axis of rotation of the new web roll $WR_2$, whose position has been computed as above. The horizontal drive motor 40 will be set out of rotation when the new web roll distance sensor 59 is so positioned.

The next step is the adjustment of the distance between the new web roll distance sensor 59 and the surface of the new web roll $WR_2$. The sensor positioning control circuit 35 will set into rotation the vertical drive motor 50 on the carriage 47. The vertical drive motor 50 will impart rotation to the nut 56 via the timing belt 53. It is assumed again that the sensor carrier 58 has been held standing by in its topmost position under the carriage 47. Therefore, with the rotation of the nut 56 in a preselected direction, the sensor carrier 58 will descend until the new web roll distance sensor 59 detects the circumference of the new web roll $WR_2$ in a preassigned position. Thereupon the vertical drive motor 50 will be set out of rotation.

Now the new web roll speed sensor 2 has been optimally positioned for sensing the peripheral speed of the new web roll $WR_2$, at a preassigned distance from, and at a preassigned angle to, the surface of the new web roll at its intersection with the vertical plane containing the axis of the new web roll. The new web roll speed sensor 2 will irradiate the new web roll surface at the required point with a laser beam, even though the new web roll $WR_2$ is understood to be still out of rotation.

Figure 4:
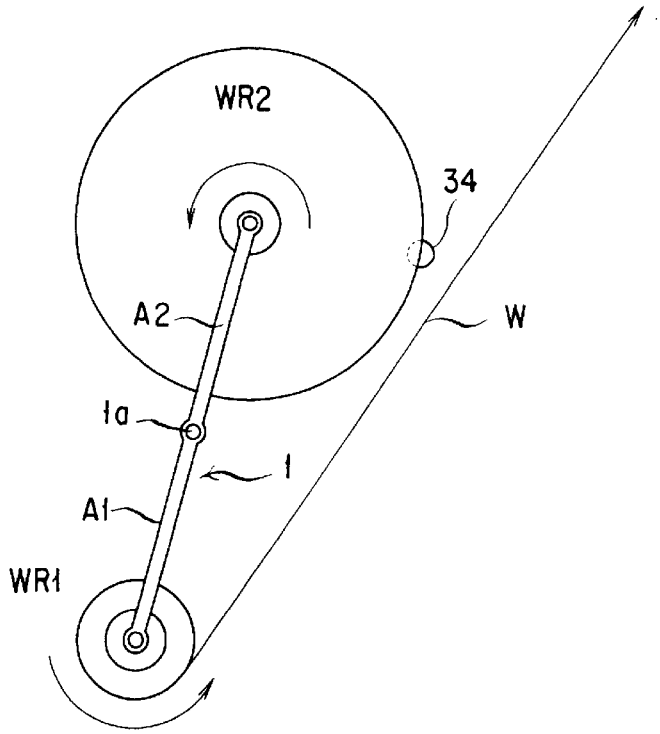

After the foregoing process of new web roll speed sensor positioning, and upon further consumption of the old web roll $WR_1$ to another prescribed diameter, the drive motor M may be drivingly coupled the new web roll $WR_2$ to drive the same in the same direction as the old web roll, as indicated by the arrows in both FIGS. 1 and 4. It is understood that, as has been practiced heretofore, the decreasing diameter of the old web roll $WR_1$ is constantly computed and ascertained both by counting the revolutions of the old web roll and from the output from the old web speed sensor 5.

The photoelectric new web roll speed sensor 2 will start putting out the electric signal indicative of the peripheral speed of the new web roll $WR_2$ as the latter commences rotation as above. This new web roll speed signal will be fed into the new web roll speed calculator circuit 71 of the new web roll drive motor control circuit 7.

Driven by the guide roller G which rotates in frictional contact with the old web W, the old web speed sensor 5 in the form of a rotary encoder will put out pulses at a rate representative of the running speed of the old web. This output from the old web speed sensor 5 will be directed into the old web speed calculator circuit 73 of the new web roll drive motor control circuit 71.

In the new web roll drive motor control circuit 7, then, the new web roll speed calculator circuit 71 will compute upon lapse of each prescribed period of time the peripheral speed of the new web roll $WR_2$ on the basis of the output from the new web roll speed sensor 2. The resulting digital output from the new web roll speed calculator circuit 71 will be delivered to the new web roll speed signal forming circuit 72, which then will respond by sending its analog equivalent to the comparator circuit 75. The old web speed calculator circuit 73 will compute the traveling speed of the old web W from the output from the old web speed sensor 5 in synchronism with the computation of the peripheral speed of the new web roll $WR_2$ by the new web roll speed calculator circuit 71. Inputting this old web speed signal from the old web speed calculator circuit 73, the old web speed signal forming circuit 74 will apply its analog equivalent to the comparator circuit 75.

The comparator circuit 75 will compare the two input signals, that is, the running speed of the web W being paid out from the old web roll $WR_1$ and fed into the press and the peripheral speed of the new web roll $WR_2$ being driven in the splicing position in the same direction as the old web roll as in FIG. 4. The resulting departure signal, indicative of the departure of the peripheral speed of the new web roll $WR_2$ from the running speed of the old web W, will be directed into the motor driver circuit 76, which will then energize the new web roll drive motor M accordingly.

The foregoing cycle of new web roll drive motor speed control is to be repeated until the peripheral speed of the new web roll $WR_2$ matches the running speed of the old web W.

The departure signal from the comparator circuit 75 will also be input as aforesaid to the speed matching determination circuit P. This circuit P will count up by one each time the incoming departure signal indicates a departure of less than a predefined limit, or, speaking more loosely, each time the departure signal indicates approximately zero departure of the peripheral speed of the new web roll $WR_2$ from the running speed of the old web W. The count will be reset when the speed departure grows greater than the predefined limit. The speed matching determination circuit P may determine that the old and the new webs have been synchronized when the count reaches, say, five.

Figure 5:
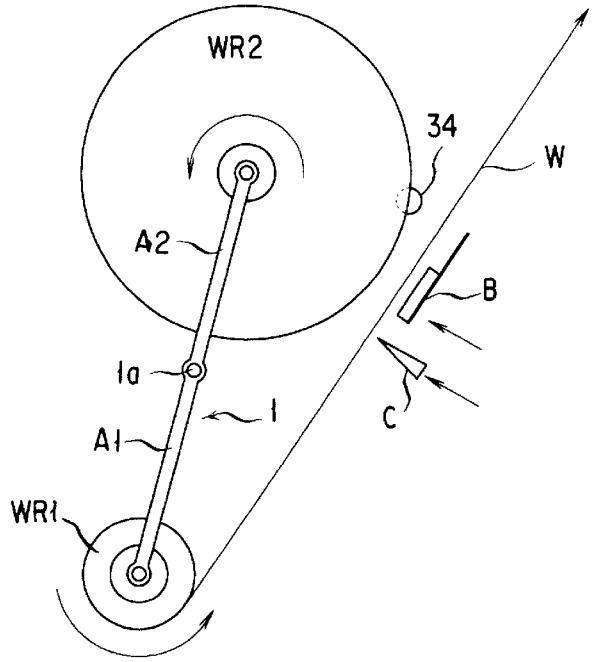
Figure 6:
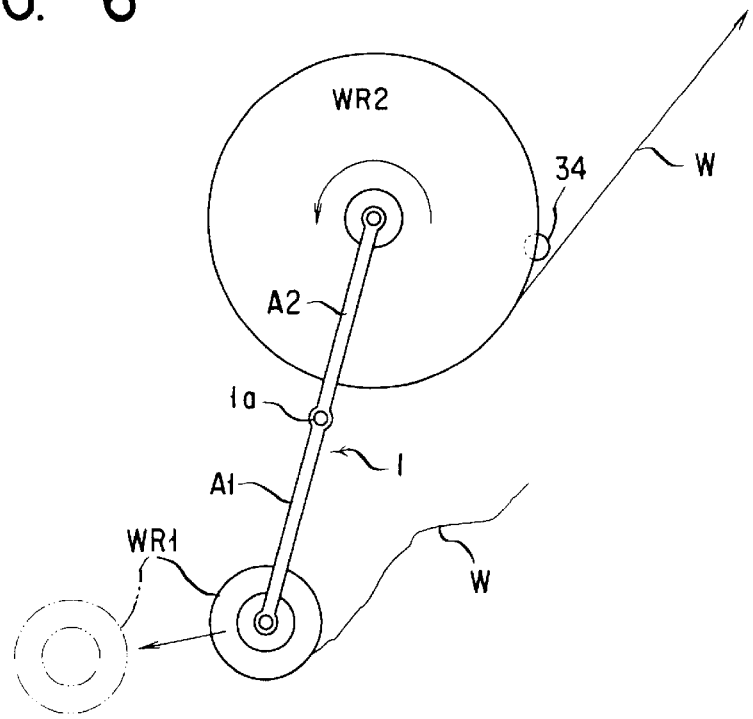

Now the webs may be spliced together. As illustrated in FIGS. 5 and 6, the splicer B may be thrust to push the old web W against the new web roll $WR_2$, and the cutter C may also be driven to sever the old web in a position just upstream of its point of attachment to the new web roll. Then the new web roll $WR_2$ will start turning, paying out the web as it is pulled into the press. The motor M is no longer required to drive the new web roll $WR_2$ and so uncoupled therefrom.

With the new web roll drive motor M uncoupled as above upon completion of splicing, the motor control circuit 7 may also be set out of operation. The sensor positioning mechanism 3, however, has still left to itself a task of returning the new web roll speed sensor 2 from its solid-line working position to phantom retracted position of FIG. 1. The horizontal drive motor 40 and vertical drive motor 50 may therefore be both energized to retract the sensor 2 and hold the same standing by pending the next splicing. The motors 40 and 50 may be automatically set out of rotation by providing switches that are actuated by the carriage 47 and sensor carrier 58 upon full retraction thereof.

Although the present invention has been shown and described in highly specific aspects thereof and as adapted for the splicing of successive rolls of paper at the infeed station of a web-fed printing press, it is understood that the invention could be embodied in other forms in similar and a variety of other applications. It is therefore appropriate that the invention be construed broadly and in a manner consistent with the fair meaning or proper scope of the subjoined claims.

What is claimed is:

1. In an apparatus for splicing a web of paper like-material, which is traveling at any given speed along a predefined path by being unwound from a first web roll, to a second web roll of a variable diameter being rotated in a splicing position in which the second web roll of any diameter is spaced a prescribed constant distance from the web traveling along the predefined path, a speed matching system for matching the peripheral speed of the second web roll to the running speed of the web traveling along the predefined path preparatory to the splicing of the webs, the speed matching system comprising:

(a) a first speed sensor for sensing the running speed of the web traveling along the predefined path by being unwound from the first web roll;

(b) web roll drive means for driving the second web roll in the splicing position;

(c) a second speed sensor for photoelectrically sensing the peripheral speed of the second web roll being driven in the splicing position;

(d) sensor positioning means for adjustably moving the second speed sensor along two orthogonal axes to an optimum sensing position with respect to the second web roll being held in the splicing position, no matter how large the second web roll may be in diameter; and (e) an electric control circuit having inputs connected to the first and the second speed sensor and an output connected to the web roll drive means for causing the web roll drive means to be controllably energized according to a departure of the peripheral speed of the second web roll in rotation in the splicing position from the running speed of the web traveling along the predefined path.

2. The invention of claim 1 wherein the sensor positioning means comprises:

(a) first drive means for moving the second speed sensor in a first direction at right angles with the axis of the second web roll being held in the splicing position;

(b) second drive means for moving the second speed sensor in a second direction at right angles with the first direction and with the axis of the second web roll being held in the splicing position; and (c) a sensor positioning control circuit electrically connected to the first and the second drive means for controlling the same.

3. The invention of claim 2 wherein at least the second web roll is rotatably supported by a rotary web roll stand which is angularly displaceable to move the second web roll from a standby position to the splicing position, and wherein the sensor positioning means further comprises:

(a) a displacement sensor for sensing the angle of displacement of the rotary web roll stand in moving the second web roll from the standby to the splicing position;

(b) the sensor positioning control circuit being electrically connected to the displacement sensor for ascertaining the position of the axis of the second web roll in the first direction on the basis of the angle of displacement of the rotary web roll stand and for causing the first drive means to bring the second speed sensor to a preselected position in the first direction.

4. The invention of claim 2 wherein the sensor positioning means further comprises:

(a) a web roll distance sensor for sensing the distance of the second speed sensor from the surface of the second web roll being held in the splicing position;

(b) the sensor positioning control circuit being electrically connected to the web roll distance sensor for causing the second drive means to bring the second speed sensor to a preselected position in the second direction in response to an output from the web roll distance sensor.

5. The invention of claim 1 wherein the sensor positioning means comprises:

(a) a carriage;

(b) first drive means for moving the carriage in a first direction at right angles with the axis of the second web roll being held in the splicing position;

(c) second drive means mounted to the carriage for movement therewith in the first direction and coupled to the second speed sensor for moving the same in a second direction at right angles with the first direction and with the axis of the second web roll being held in the splicing position; and (d) a sensor positioning control circuit electrically connected to the first and the second drive means for controlling the same.

6. The invention of claim 5 wherein at least the second web roll is rotatably supported by a rotary web roll stand which is angularly displaceable to move the second web roll from a standby position to the splicing position, and wherein the sensor positioning means further comprises:

(a) a sensor carrier through which the second drive means is coupled to the second speed sensor;

(b) a web roll distance sensor mounted to the sensor carrier in prescribed positional relationship to the second speed sensor for sensing a distance from the surface of the second web roll being held in the splicing position; and (c) a displacement sensor for sensing the angle of displacement of the rotary web roll stand in moving the second web roll from the standby to the splicing position;

(d) the sensor positioning control circuit being electrically connected to the displacement sensor for ascertaining the position of the axis of the second web roll in the first direction on the basis of the angle of displacement of the rotary web roll stand and for causing the first drive means to bring the web roll distance sensor to a position of register with the axis of the second web roll in the second direction.

7. The invention of claim 5 wherein the sensor positioning means further comprises:

(a) a sensor carrier through which the second drive means is coupled to the second speed sensor; and (b) a web roll distance sensor mounted to the sensor carrier in prescribed positional relationship to the second speed sensor for sensing a distance from the surface of the second web roll being held in the splicing position;

(c) the sensor positioning control circuit being electrically connected to the web roll distance sensor for causing the second drive means to bring the second speed sensor to a preselected position in the second direction in response to an output from the web roll distance sensor.

8. The invention of claim 1 wherein the electric control circuit comprises:

(a) web roll speed calculator means connected to the second speed sensor for computing at prescribed time intervals the peripheral speed of the second web roll being driven in the splicing position;

(b) web speed calculator means connected to the first speed sensor for computing, in synchronism with the computation of the peripheral speed of the second web roll by the web roll speed calculator means, the running speed of the web traveling along the predefined path;

(c) a comparator circuit connected to the web roll speed calculator means and the web speed calculator means for providing an output indicative of a departure of the peripheral speed of the second web roll from the running speed of the web traveling along the predefined path; and (d) a driver circuit connected between the comparator circuit and the web roll drive means for driving the latter so as to reduce the departure to zero.

9. The invention of claim 1 wherein the second speed sensor senses the peripheral speed of the second web roll on the basis of interference fringes created by two crossing beams of light.

10. The invention of claim 1 wherein the second speed sensor senses the peripheral speed of the second web roll on the basis of the frequency deviation of a light beam reflected back from the surface of the second web roll.

11. The invention of claim 1 wherein, after the sensor positioning means positions the second speed sensor when the second web roll is in the splicing position, the second speed sensor lies at a preselected angle to and at a preselected distance from a line of intersection of a vertical plane disposed on a surface of the second web roll, the vertical plane containing an axis of rotation of the second web roll.

* * * * *